United States Patent [19]

Aspinwall

[11] 4,422,475

[45] Dec. 27, 1983

[54] VARIABLE GAIN SERVO CONTROLLED DIRECTIONAL VALVE

[75] Inventor: Ronald A. Aspinwall, Detroit, Mich.

[73] Assignee: Vickers, Incorporated, Troy, Mich.

[21] Appl. No.: 268,489

[22] Filed: May 29, 1981

[51] Int. Cl.[3] ..... F15B 13/044

[52] U.S. Cl. ..... 137/630.15; 137/596.17; 137/625.48; 137/870; 137/625.65; 251/137

[58] Field of Search ..... 137/596.17, 625.48, 137/625.65, 630.15, 870; 251/137

[56] References Cited

U.S. PATENT DOCUMENTS

| | | | |
|---|---|---|---|
| 2,630,136 | 3/1953 | Brandes et al. | 251/137 X |
| 2,917,078 | 12/1959 | Floyd | 137/625.65 |
| 3,252,482 | 5/1966 | Kumm | 137/625.48 |
| 3,253,613 | 5/1966 | Richolt | 137/625.48 X |
| 3,550,631 | 12/1970 | Vanderlaan | 137/625.65 |
| 3,768,376 | 10/1973 | Orme | 137/596 X |
| 4,090,429 | 5/1978 | Kamimura | 137/596 X |
| 4,333,387 | 6/1982 | Seitz | 137/596 X |

*Primary Examiner*—Gerald A. Michalsky
*Attorney, Agent, or Firm*—Barnes, Kisselle, Raisch, Choate, Whittemore & Hulbert

[57] ABSTRACT

A variable gain servo solenoid controlled directional valve comprising a valve body having an elongated bore, a sleeve in the bore, a spool reciprocable in the sleeve and a force motor for reciprocating the spool and/or sleeve. The valve body has an inlet pressure port and outlet pressure ports to the interior of the sleeve. The spool controls the flow through the sleeve and is movable from a null position to selective positions permitting flow to the outlets of the body. The sleeve includes a bypass channel formed on the periphery thereof. Upon shifting of the spool fluid flow is under the control of the spool to one of the outlets in the body. Upon continued movement of the spool the sleeve is moved axially so additional fluid will flow from the inlet port in the body through the bypass channel to the selected output port of the body without passing through the interior of the sleeve.

27 Claims, 5 Drawing Figures

VARIABLE GAIN SERVO CONTROLLED DIRECTIONAL VALVE

This invention relates to power transmission and particularly to directional valves for controlling flow to remotely positioned hydraulically operated devices.

BACKGROUND AND SUMMARY OF THE INVENTION

In hydraulically driven devices, it has become more and more common to provide remote directional control of the devices in order to increase productivity, provide more economical and precision operation and reduce material and costs. It is common to utilize various remote controls such as cables, cams, mechanical linkages, pilot valves, and on/off solenoid operated valves. Each of these control methods has disadvantages. For example, flexible cables and linkages are heavy and cumbersome, cams are expensive to generate, and pilot valves require extra piping and valving. Solenoids which are of the on/off type do not provide good metering.

It is known to use force motors or proportional actuators in connection with electronic control circuitry to overcome some of the above noted problems. Force motors or proportional actuators, such as servo solenoids, have an armature or plunger which is placed in contact with the spool of a directional valve.

The plunger stroke includes an approach zone and a control zone. The control zone is the segment of the stroke that can be proportionally controlled and the null position of the plunger is set to coincide with the start of the control zone segment of the plunger stroke.

The stroke of the plunger and therefore that of the valve spool is proportional to the input current of the solenoid. Merely increasing or decreasing the input current enables positioning of the plunger and, in turn, the spool at any point along its stroke to control the fluid flow through the directional valve.

It is also known to use feedback devices, such as a linear variable differential transformer, commonly known as an LVDT, is incorporated in a servo solenoid when increased accuracy and repeatability is desired. The LVDT monitors the armature position. The electronic circuitry compares the input signal with the feedback signal of the LVDT and eliminates any error signal between the two. Thus, by monitoring the armature position, the spool position is known for a given input signal to the solenoid and the spool position is always the same with regard to that input signal. This allows for repeatibility of the spool position in comparison to the electrical input signal to the solenoid.

Servo solenoids of the type discussed above are described in U.S. Pat. No. 4,044,324 and in Catalog No. SS-1104 dated October, 1979, published by Ledex Inc. of Vandalia, Ohio, United States.

However, the above discussed servo solenoid controlled valves are limited in the amount of fluid that can be controlled for a given solenoid size and the servo solenoid and valve must be designed for a particular size hydraulic system. Where dynamic flow and spring forces acting of the valve spool exceed the force limitation of the servo solenoid, the valve can not be controlled by a servo solenoid, and servo solenoid controlled pilot valves are required. Also it has been difficult to provide for an adjustable flow gain without the use of special structures, spool metering grooves, and shims. Additionally, repeatability of the position of the valve spool requires accurate positioning of the null position of the spool, that is, the overlap between spool lands to the openings of ports leading into the spool bore and also the null positioning of the plunger in relation to the start of the control zone segment of the armature stroke. The latter is especially critical with the use of an LVDT. The setting of the null position has in the past been accomplished, at some inconvenience, by the use of shims.

Among the objectives of the present invention are to provide a variable gain controlled directional valve and particularly a servo solenoid operated valve which has variable flow gain, permits positioning of the control member or spool without shims or special machining, reduces the number of parts required to provide design variation, and has low hysteresis.

In accordance with the invention, the variable gain servo controlled directional valve comprises a valve body having an elongated bore, a sleeve in the bore, a spool mounted for reciprocating movement in the sleeve and a force motor for reciprocating the spool. The valve body has an inlet pressure port and outlet pressure ports connected to inlet and outlet chambers, and the sleeve has passages permitting flow from the inlet chamber to the interior of the sleeve. The spool controls the flow through the sleeve and is movable from a null position to selective positions permitting flow to the outlet chambers of the body. The sleeve includes a bypass channel whereby upon shifting movement of the sleeve relative to the body, the sleeve will permit increased fluid flow from the inlet chamber of the body directly to one or the other of the outlet chambers without affecting the dynamic flow and spring forces acting on the spool. Means are operable upon shifting of the spool to initially permit fluid flow through the sleeve under the control of the spool to one of the outlet chambers in the body and upon continued movement of the spool to cause the sleeve to be moved axially so additional fluid will flow from the inlet chamber in the body to the selected outlet chamber in the body.

DESCRIPTION

Figure 1:
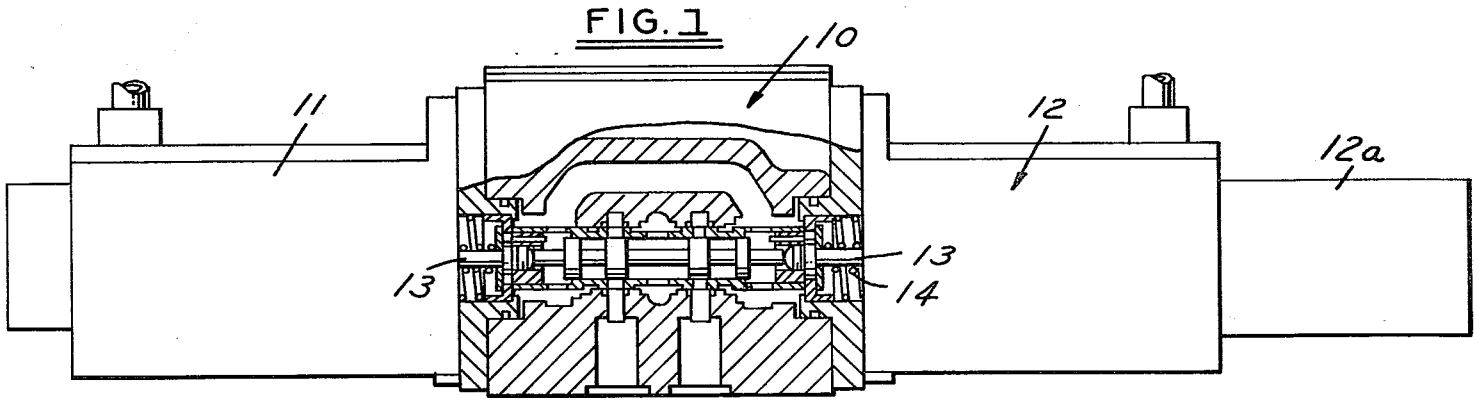
FIG. 1 is a part sectional view of a variable gain servo controlled directional valve embodying the invention.

Referring to FIG. 1, the variable gain servo controlled directional valve embodying the invention comprises a valve 10 and solenoids 11, and a solenoid 12 having a linear variable displacement transformer or LVDT 12*a* incorporated therewith. Each servo solenoid includes a plunger 13 that is movable inwardly toward the valve 10 upon energization of the solenoid against the action of a spring 14.

Figure 3:
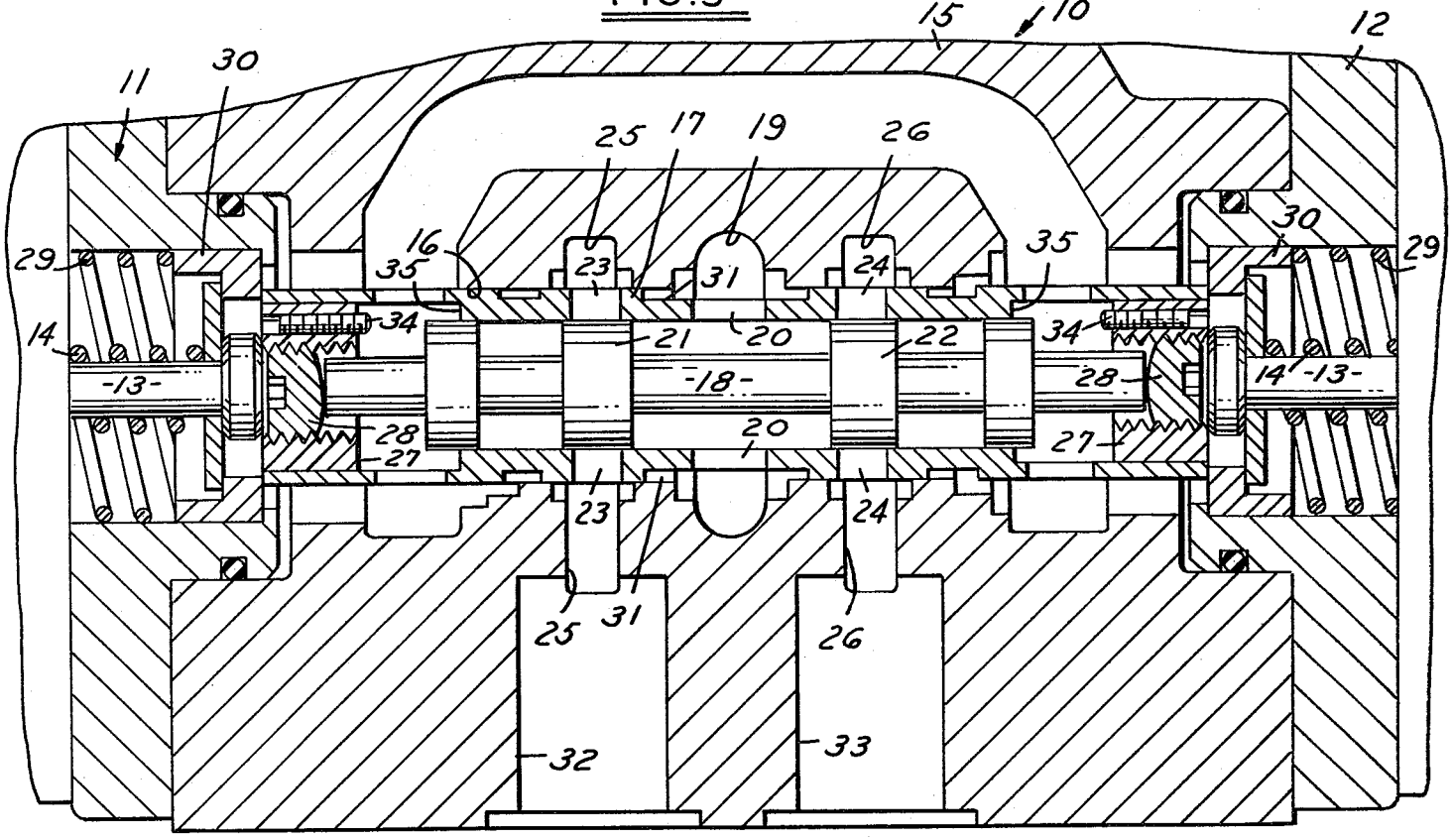
FIG. 3 is a fragmentary longitudinal sectional view of the valve shown in FIG. 1 on an enlarged scale.

As shown in FIG. 3, valve 10 includes a valve body 15 having a longitudinally extending bore 16 concentrically aligned with the plunger 13. A sleeve 17 is axially slideable in the bore 16 and a spool 18 is axially slideable in the sleeve 17. The body 15 includes an inlet chamber 19 in the form of an annular groove about the bore which is supplied through an inlet port (not shown) with fluid from the exterior of the valve body. The sleeve 17 includes neutral openings 20 whereby the fluid flows from the inlet chamber 19 to the interior of the sleeve 17 between lands 21, 22 formed on spool 18. Movement of the lands 21, 22 to the left or to the right permits the fluid to flow selectively through openings 23 or 24 formed in the sleeve to outlet chambers 25, 26 formed in the valve body and, in turn, to flow to the hydraulic device such as a motor (not shown) which is being controlled through outlet ports 32, 33 formed in the valve body.

Movement of the plunger 13 of the solenoid is transmitted to the spool 18 through a bearing member 27 that is slideably mounted in the end of the sleeve 17 and engages the end of the spool 18 through an adjustable axially threaded screw 28.

The sleeve 17 is maintained in its neutral position by springs 29 interposed between the body of the solenoid and annular pressure members 30.

The sleeve 17 further includes a bypass channel 31 formed by annular recess in the outer surface of the sleeve so that if the sleeve is axially shifted to the left or to the right, fluid may flow directly from the inlet chamber 19 to annular chambers 25 or 26 to the selected outlet port 32 or 33 without passing through the spool.

Movement of the sleeve 17 is controlled by an axially threaded screw 34 which is positioned in the bearing member 27 so that after a predetermined initial movement of the bearing member and, in turn, the spool, the sleeve is engaged as at shoulder or surface 35 by screw 34 and moved to permit the bypass flow. As a result, the gain of the valve can be controlled.

Figure 2:
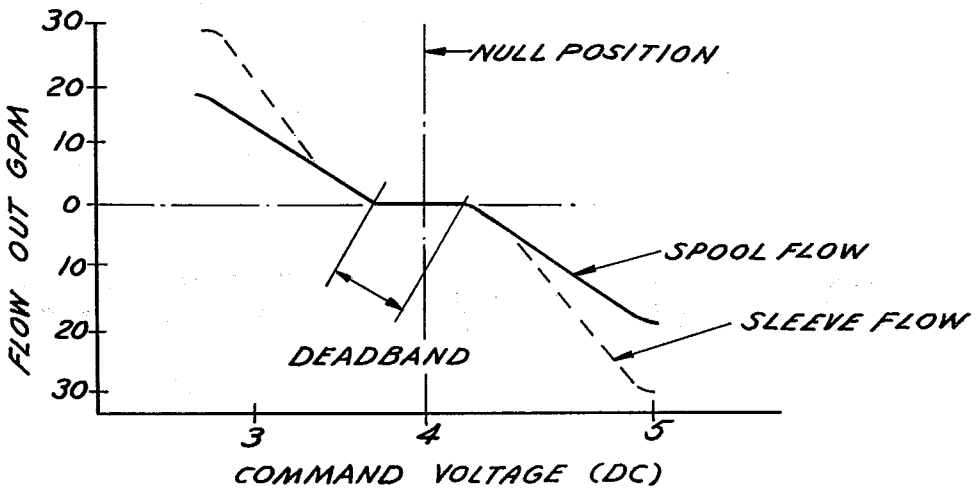
FIG. 2 is a curve of flow versus command voltage.

As shown in FIG. 2, the curve of fluid flow versus current to the solenoid represented in solid lines is that of the spool flow obtained without movement of the sleeve. However, by use of the sleeve, the additional or sleeve flow at greater levels of energization is represented by the broken lines.

The provision of the screw 34 permits the adjustment of the amount of sleeve flow or gain that can be obtained, that is, permits the determination of the point in the movement of the spool at which the sleeve will be moved to permit additional flow without affecting the dynamic flow and spring force acting on the spool. With the described arrangement it is possible to control sleeve flow independent of spool movement. In this case adjusting screw 28 is retracted and adjustment screw 34 is extended to make contact with surface 35 of the sleeve at the start of the plunger stroke.

Since the screw 28 adjusts the null or zero position of the spool, the position of the spool can be readily adjusted and this can be done in the assembly of the sleeve, spool and bearing member prior to insertion in the valve body. The provision of a rounded end on the screw 28 eliminates mechanical binding and the reaction force is transmitted to the bearing member 27.

Figure 4:
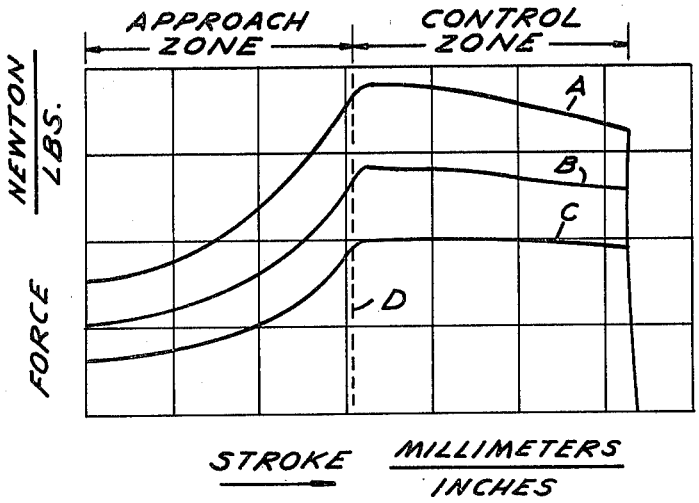
FIG. 4 is a curve of stroke versus force of a servo solenoid.

The construction permits the operation of the directional valve in conjunction with solenoids that do not have linear force-stroke curves throughout the range of energization of the solenoid. This may be more readily understood by reference to FIG. 4 which shows curves of force or energization versus stroke for solenoids at three different energization cycles A, B, and C. It can be seen that in the first part of the plunger displacement, called the approach zone, the curves are not linear, but in the second portion of the displacement, called the control zone, the curves are substantially linear. In order to utilize solenoids in the control zone, the null position of the spool 18 is adjusted and the solenoids are assembled to the valve so that the stroke of plunger 13 is positioned within the control zone. Thereafter, energization of the solenoid will result in a linear movement of the plunger and the spool and/or sleeve.

It can thus be seen that there has been provided a variable gain servo solenoid controlled directional valve which will produce special flow pressure profile requirements, reduce the number of parts required to provide for design variations, permit spool null adjustment without shims or special machining, and reduce hysteresis.

Figure 5:
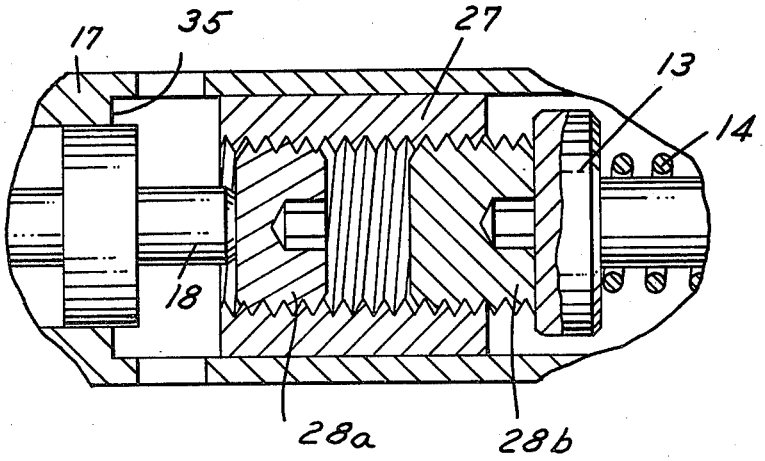
FIG. 5 is a fragmentary longitudinal section view of another embodiment of the adjustment means shown in FIG. 1 on an enlarged scale.

In valves that use solenoids which incorporate an LVDT it is desirable to achieve a more precise positioning of the null position of the plunger. In the construction shown in FIG. 5, a separate screw **28*b* is provided between the plunger and bearing member 27. By this arrangement, the spool 18 can be adjusted to its null position independently of the plunger by the screw 28*a*. The positioning of the plunger to its initial or null position at the broken line D, FIG. 4, at the beginning of the control zone can be achieved independently of the spool position by the screw 28*b***. Such more precise null positioning of the plunger is particularly desirable when an LVDT is incorporated with the servo solenoid or when it is desired to position the plunger of a servo solenoid without the LVDT at some intermediate position of the control zone while maintaining the spool at the null position relative to the valve body.

Although the invention has been described as having particular utility in connection with a servo solenoid type force motor at opposite sides of the valve body, other force motors can be utilized, and as will be apparent to persons skilled in the art the invention is applicable to hydraulic systems requiring control of the spool position by a servo solenoid at one end of the valve body only. In the latter case, one solenoid is eliminated and is replaced with a valve body end cap. Spring 14 is replaced with a spring member acting between the end cap and the bearing member 27.

I claim:

1. A variable gain servo controlled directional valve comprising a valve body having an elongated bore, a sleeve in said bore, a spool mounted for reciprocating movement in said sleeve, a force motor for positioning said spool in said sleeve, said valve body having an inlet pressure port and outlet pressure ports, said sleeve having passages permitting flow from said pressure ports to the interior of said sleeve, said spool controlling the flow through the sleeve and movable from a null position to selective positions permitting fluid flow to said outlets of said body, said sleeve including a bypass channel whereby upon shifting movement of said sleeve relative to said body, said bypass channel will permit fluid flow from said inlet port in said body to one of the outlet ports, and means operable upon movement of said force motor to selectively control movement of said sleeve and said spool, said last-mentioned means being operable upon shifting of said spool to initially permit flow under the control of said spool to one of said outlets in said body and upon continued movement of said spool to cause said sleeve to be moved axially so additional fluid will flow from said inlet port in said body to the selected outlet port of said body, and includes means for adjustably controlling the point in the axial movement of said spool when the axial movement of said sleeve is initiated.

2. The variable gain servo controlled directional valve set forth in claim 1 wherein said last-mentioned means comprises a bearing member in said sleeve interposed between said force motor and spool and axially movable within said sleeve and interengaging means between said bearing member and said sleeve engageable upon predetermined movement of said spool to move said sleeve.

3. The variable gain servo controlled directional valve set forth in claim 2 including means for axially adjusting the position of said bearing member relative to said spool.

4. The variable gain servo controlled directional valve set forth in claim 3 including means for adjusting the axial engaging portion of said bearing member with respect to said sleeve.

5. The variable gain servo controlled directional valve set forth in claim 4 including spring means interposed between said force motor and said valve body for urging said sleeve and said spool to a neutral position with respect to said valve body.

6. The variable gain servo controlled directional valve set forth in claim 5 wherein said force motor includes a plunger member, said adjustment means include an axially movable bearing member mounted in said sleeve between said spool and said plunger member, whereby operation of said plunger member effects displacement of said bearing member within said sleeve member.

7. The variable gain servo controlled directional valve set forth in claim 6 wherein said sleeve member includes an internal annular shoulder adjacent said bearing member and said bearing member includes a second adjustable member extending axially in the direction of and aligned with said annular shoulder whereby extension or retraction of said second adjustable member advances or delays displacement of the sleeve member relative to the spool in response to movement of the plunger member.

8. The variable gain servo controlled directional valve set forth in claim 1 wherein said force motor comprises a solenoid including a plunger.

9. The variable gain servo controlled directional valve set forth in claim 8 wherein said plunger member and said spool have axial null positions, and means for adjusting the axial null positions of said plunger member and said spool independently of one another.

10. The variable gain servo controlled directional valve set forth in claim 9 wherein said last mentioned means comprises an axially movable bearing member mounted in said sleeve between said spool and said plunger member, adjustable means between said spool and said bearing member and adjustable means between said sleeve and said plunger member.

11. The variable gain servo controlled directional valve set forth in claim 10 wherein said sleeve member includes an internal annular shoulder adjacent said bearing member and said bearing member includes a third adjustable member extending axially in the direction of and aligned with said annular shoulder whereby extension or retraction of said third adjustable member advances or delays displacement of the sleeve member relative to the spool in response to movement of the plunger member.

12. A variable gain servo controlled directional valve comprising a valve body having an elongated bore, a sleeve in said bore, a spool mounted for reciprocating movement in said sleeve, a pair of force motors for reciprocating said spool, said valve body having an inlet pressure port and outlet pressure ports, said sleeve having passages permitting flow from said pressure ports to the interior of said sleeve, said spool controlling the flow through said sleeve and movable from a null position to selective positions permitting flow to said outlets of said body, said sleeve including a bypass channel whereby upon shifting movement of said sleeve relative to said body, said bypass channel will permit fluid flow from said inlet port in said body to one of the outlet ports, and means operable upon movement of said force motor to selectively control movement of said sleeve and said spool, said last-mentioned means being operable upon shifting of said spool in each direction for initially permitting fluid flow under the control of said spool to one of said outlets in said body and upon continued movement of said spool for causing said sleeve to be moved axially so additional fluid will flow from said inlet port in said body through said bypass channel to the selected outlet port of said body, and includes means for adjustably controlling the point in the axial movement of said spool when the axial movement of said sleeve is initiated.

13. The variable gain servo controlled directional valve set forth in claim 12 wherein said last-mentioned means comprises a bearing member in said sleeve interposed between each said force motor and said spool and reciprocable within said sleeve such that said bearing member moves said sleeve and interengaging means between said bearing member and said sleeve engageable upon predetermined movement of said spool to move said sleeve.

14. The variable gain servo controlled directional valve set forth in claim 13 including means for axially adjusting the position of each said bearing member relative to said spool.

15. The variable gain servo controlled directional valve set forth in claim 14 including means for adjusting the axially engaging portion of each said bearing member which engages said sleeve with respect to said sleeve.

16. The variable gain servo controlled directional valve set forth in claim 15 including spring means interposed between each said force motor and said valve body for urging said sleeve and said spool to a neutral position with respect to said valve body.

17. The variable gain servo controlled directional valve set forth in claim 16 wherein said force motor includes a plunger member, said adjustment means include an axially movable bearing member mounted in said sleeve member between said spool and each said plunger member, whereby operation of said plunger member effects displacement of said bearing member within said sleeve.

18. The variable gain servo controlled directional valve set forth in claim 17 wherein said sleeve includes an internal annular shoulder adjacent each said bearing member and each said bearing member includes a second adjustable member extending axially in the direction of and aligned with said annular shoulder whereby extension or retraction of said second adjustable member advances or delays displacement of the sleeve member relative to the spool member in response to movement of the plunger member.

19. The variable gain servo controlled directional valve set forth in claim 18 wherein said force motors comprise solenoids.

20. The variable gain servo controlled directional valve set forth in claim 19 wherein said plunger member and said spool have axial null positions, and means for adjusting the axial null positions of said plunger member and said spool independently of one another.

21. The variable gain servo controlled directional valve set forth in claim 20 wherein said last mentioned means comprises an axially movable bearing member mounted in said sleeve between said spool and said plunger member, adjustable means between said spool and said bearing member and adjustable means between said sleeve and said plunger member.

22. The variable gain servo controlled directional valve set forth in claim 21 wherein said sleeve member includes an internal annular shoulder adjacent said bearing member and said bearing member includes a third adjustable member extending axially in the direction of and aligned with said annular shoulder whereby extension or retraction of said third adjustable member advances or delays displacement of the sleeve member relative to the spool in response to movement of the plunger member.

23. A variable gain control for a servo solenoid operated directional valve comprising;

a. a valve body having an elongated bore formed therein, b. a sleeve member mounted for axial movement within said bore, c. a spool member mounted for axial movement within said sleeve member, d. a servo solenoid mounted at one end of said valve body and having a plunger member extending therefrom in the direction of said valve body in axial alignment with said spool member, e. spring means interposed between said solenoid and said valve body for urging said sleeve member and said spool member to a neutral position within and said valve body, and f. adjustment means mounted in said sleeve member between said spool member and said plunger member for adjusting said spool member to a null position relative to said sleeve member and for adjusting the axial displacement of said sleeve member relative to said spool member in response to movement of said plunger member.

24. The gain control of claim 23 wherein said adjustment means include an axially movable bearing member mounted in said sleeve member between said spool member and said plunger member, wherein operation of said plunger member effects displacement of said bearing member within said sleeve member.

25. The gain control of claim 24 wherein said bearing member includes a first adjustable member extending axially in the direction of and abutting against said spool member whereby extension or retraction of said first adjustable member displaces the spool member axially relative to said sleeve member.

26. The gain control of claim 24 wherein said sleeve member includes an internal annular shoulder adjacent said bearing member and said bearing member includes a second adjustable member extending axially in the direction of and aligned with said annular shoulder whereby extension or retraction of said second adjustable member advances or delays displacement of the sleeve member relative to the spool member in response to movement of the plunger member.

27. The gain control of claim 23, 24, 25 or 26 wherein a servo solenoid is mounted at opposite ends of said valve body.

* * * * *